US006152089A

United States Patent [19]

Neumann et al.

[11] Patent Number: 6,152,089

[45] Date of Patent: Nov. 28, 2000

[54] PORTABLE HANDHELD WORK APPARATUS SUCH AS A MOTOR-DRIVEN CHAIN SAW

[75] Inventors: Philipp Neumann; Bernhard Dürr, both of Stuttgart; Helmut Lux, Waiblingen; Eberhard Bohnaker, Leutenbach, all of Germany

[73] Assignee: Andreas Stihl AG & Co., Waiblingen, Germany

[21] Appl. No.: 09/198,499

[22] Filed: Nov. 24, 1998

[30] Foreign Application Priority Data

Nov. 25, 1997 [DE] Germany ..... 297 20 866 U

[51] Int. Cl.[7] ..... F01P 1/02

[52] U.S. Cl. ..... 123/41.7

[58] Field of Search ..... 123/198 E, 41.56, 123/195 C, 41.7

[56] References Cited

U.S. PATENT DOCUMENTS

| | | | |
|---|---|---|---|
| 4,019,490 | 4/1977 | Reese | 123/185.2 |
| 4,543,915 | 10/1985 | Nagashima et al. | 123/41.65 |
| 4,561,386 | 12/1985 | Tamba et al. . | |
| 4,850,233 | 7/1989 | Ishigo | 74/6 |
| 4,928,643 | 5/1990 | Kampichler et al. | 123/185.3 |
| 5,168,837 | 12/1992 | Scholz | 123/41.7 |
| 5,267,540 | 12/1993 | Zerrer et al. . | |
| 5,269,265 | 12/1993 | Pretzsch et al. | 123/41.56 |
| 5,526,777 | 6/1996 | Taomo et al. | 123/41.65 |
| 5,542,380 | 8/1996 | Chatten | 123/41.7 |
| 5,687,689 | 11/1997 | Santos | 123/198 E |
| 5,934,240 | 8/1999 | Yokocho et al. | 123/195 C |

FOREIGN PATENT DOCUMENTS 2475625 8/1981 France .

*Primary Examiner*—Willis R. Wolfe
*Assistant Examiner*—Jason Benton
*Attorney, Agent, or Firm*—Walter Ottesen

[57] ABSTRACT

The invention relates to a portable handheld work apparatus such as a motor-driven chain saw having an internal combustion engine mounted in a housing for driving a work tool. A cooling-air blower is mounted on one side of the housing. The cooling-air blower is covered by a blower cover having air-intake openings. The blower cover has a bearing lug facing toward the cooling-air blower. A pull-rope starter for starting the engine is held on the bearing lugs and the housing of the pull-rope starter is attached to the blower cover. The pull-rope starter housing is configured as a component separate from the blower cover in order to minimize the disturbance of the cooling-air inflow by the pull-rope starter housing. This component is attached at a spacing to the air-intake openings of the blower.

10 Claims, 3 Drawing Sheets

PORTABLE HANDHELD WORK APPARATUS SUCH AS A MOTOR-DRIVEN CHAIN SAW

FIELD OF THE INVENTION

The invention relates to a portable handheld work apparatus such as a motor driven chain saw, cutoff machine, brushcutter or the like.

BACKGROUND OF THE INVENTION

In a known arrangement, the pull-rope starter, which is mounted between the blower cover and the cooling-air blower, is so integrated into the blower cover that the housing of the return spring of the pull-rope starter is manufactured as a single piece with the blower cover, for example, as a magnesium cie-cast part. No entry of air is possible over the entire surface of the spring housing configured in the blower cover. The effective air entry surface of the blower cover is limited by the pull-rope starter.

SUMMARY OF THE INVENTION

It is an object of the invention to configure the blower cover for a portable handheld work apparatus in such a manner that a maximum air entry surface is provided.

The invention is for a portable handheld work apparatus including a motor-driven chain saw, brushcutter, cutoff machine or the like. The work apparatus has a work tool and includes: a housing having a side region; an internal combustion engine mounted in the housing for driving the work tool; a cooling-air blower mounted in the side region for supplying a flow of cooling air for cooling the engine; a blower cover mounted in the side region upstream of the cooling-air blower; the blower cover having a plurality of air-intake openings formed therein; a pull-rope starter for starting the engine and said pull-rope starter having a return spring; the blower cover having a bearing lug for accommodating the pull-rope starter thereon and the bearing lug being mounted on said blower cover so as to face toward the cooling-air blower; a return-spring housing for holding the return spring therein; the return-spring housing being configured as a component separate from the blower cover; and, the return-spring housing being attached to the blower cover at a spacing (u) from the air-intake openings.

The air entry surface of the blower cover can be maximized with respect to flow because of the configuration of the spring housing as a component separate from the blower cover. The component of the pull-rope starter is then so attached to the blower cover that its housing of the return spring lies at a spacing to the air-intake openings insofar as a closing of the air intake openings is avoided in the region of the spring housing. In this way, cooling air can also enter through the air-intake openings covered in the plan view by the pull-rope starter and can flow past the pull-rope starter to the cooling-air blower. For a structure unchanged in size, a larger air quantity can flow into the cooling air housing and the cooling is improved. For the same air quantity, the inflow velocity of the air is reduced and so is the underpressure at the blower grating and the accumulation of dirt is reduced.

Preferably, the spring housing of the pull-rope starter lies on the inner ribs of the blower cover which are advantageous for the reinforcement of this cover. In this way, a stiff support and attachment at the blower cover is made possible without hindering the air entry through the air-intake openings covered by the pull-rope starter. The ribs determine the spacing of the spring housing to the air-intake openings.

In an advantageous further embodiment of the invention, one end of the bearing lug is held in an attachment base of the blower cover and is preferably held with a threaded fastener, is pressed or is coated. The air-intake openings in the blower cover extend to the edge of the attachment base. Air guide channels are formed which extend outwardly between the spring housing, the ribs and the attachment base. These air guide channels divert the air, which enters in the covering region of the pull-rope starter, into the air-guide housing of the blower cover.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
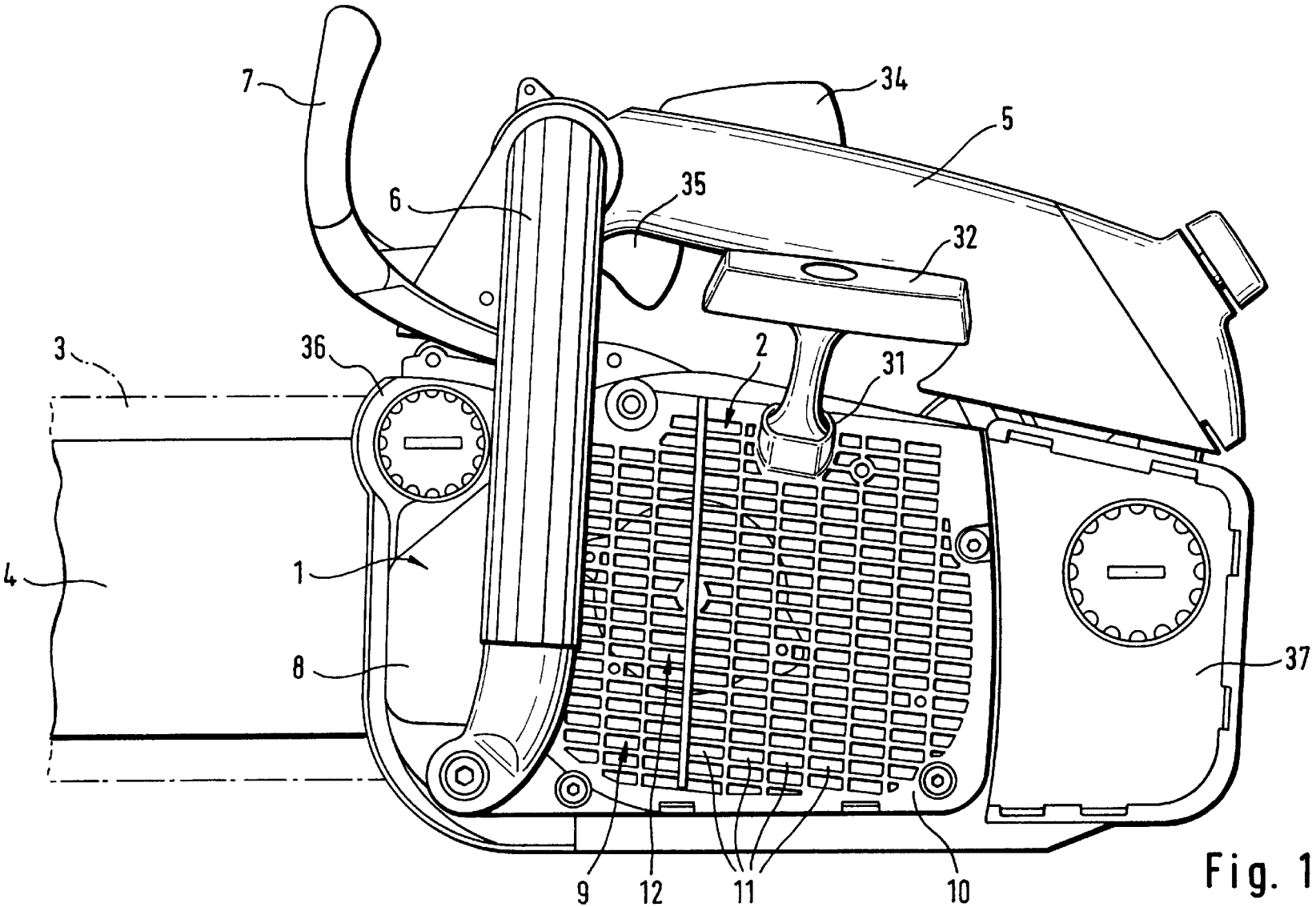
FIG. 1 is a perspective view of a portable handheld work apparatus which here is, as an example, a motor-driven chain saw.

The portable handheld work apparatus shown in FIG. 1 is a motor-driven chain saw which, essentially, includes a housing 1 having an internal combustion engine 2 mounted therein for driving a work tool. In the example of the motor-driven chain saw, the work tool is a saw chain 3 running about the periphery of the guide bar 4. The work apparatus is held and guided with an upper handle 5 and a forward lateral handle 6. The upper handle 5 extends in the longitudinal direction of the chain saw. A guard lever 7 of a safety brake arrangement is mounted forward of the forward handle 6. A throttle-lever latch 34 and a throttle lever 35 are mounted in the upper handle 5. Chain oil is held in a forward oil tank 36 and a mixture is filled into a rearward fuel tank 37.

In lieu of a motor-driven chain saw, the portable handheld work apparatus can also be configured as a cutoff machine, a brushcutter or the like.

The combustion engine mounted in the housing 1 is a two-stroke engine, a four-stroke engine or a two-stroke engine equipped with valves. A cooling air blower 9 is mounted on a housing side 8 in order to provide the necessary cooling. The cooling air blower 9 is not shown in greater detail and is covered by a blower cover 10. The entire surface of the blower cover 10 lying opposite the housing side 8 is provided with air-intake openings 11 via which the cooling air is drawn in by suction.

A pull-rope starter 12 is provided between the blower cover 10 and the blower 9 on the blower cover. The pull-rope starter 12 is provided to start the internal combustion engine.

Figure 2:
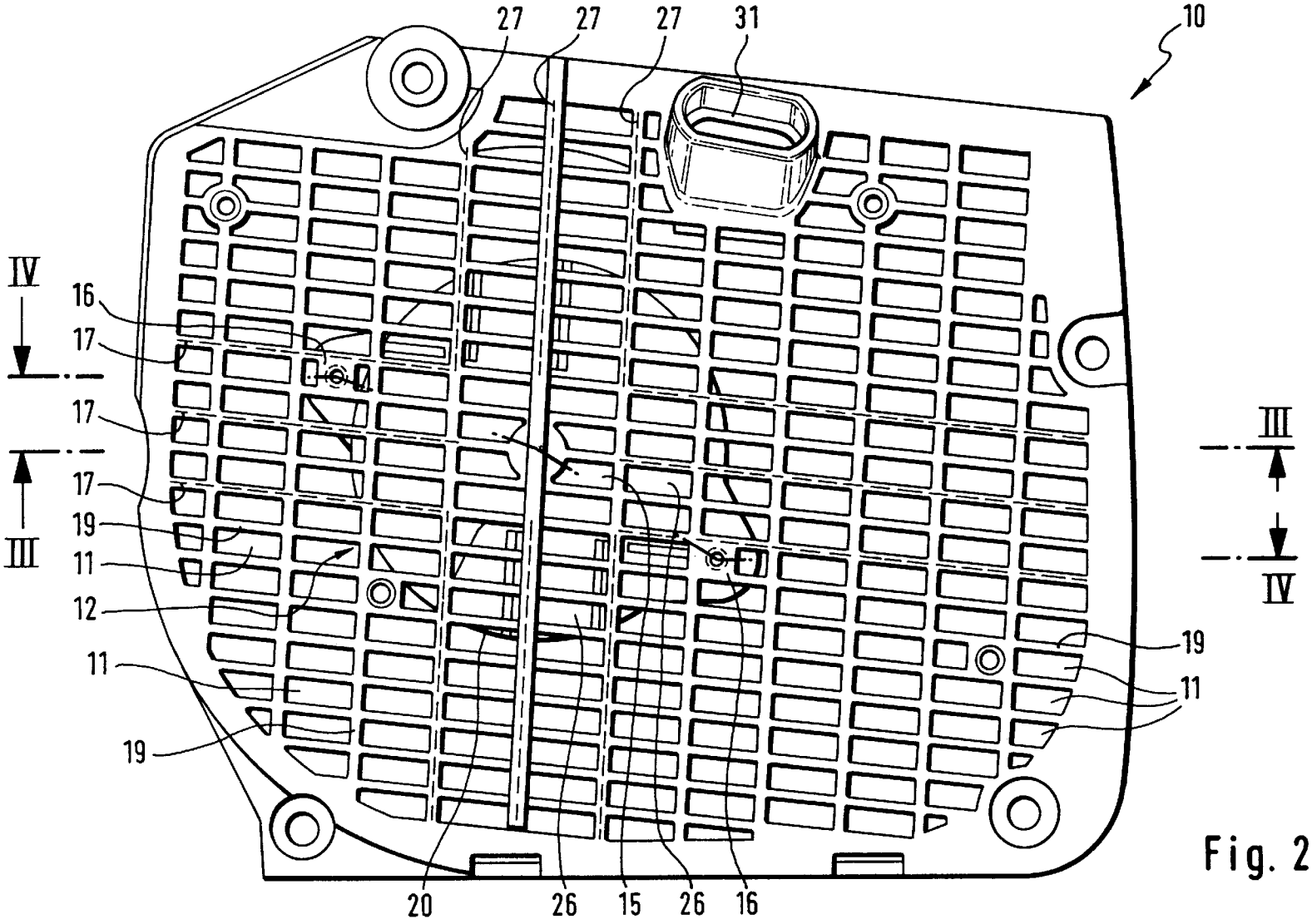
FIG. 2 is an enlarged plan view of the blower cover of the work apparatus.
Figure 3:
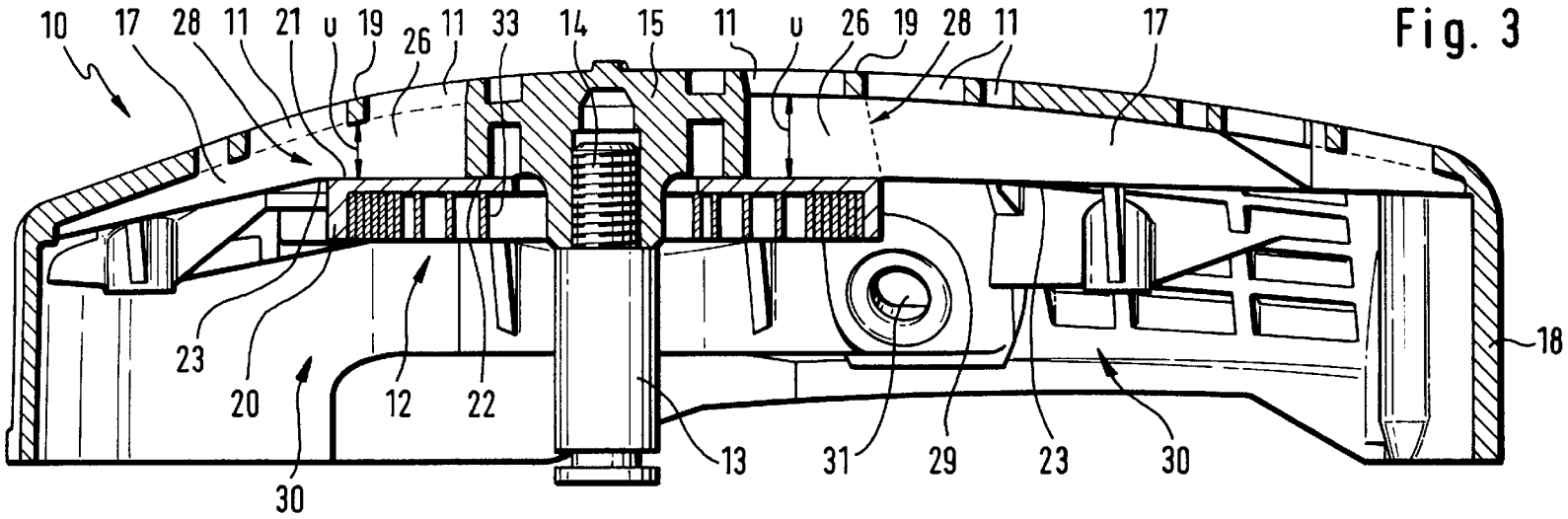
FIG. 3 is a section view taken along line III—III of FIG. 2.
Figure 4:
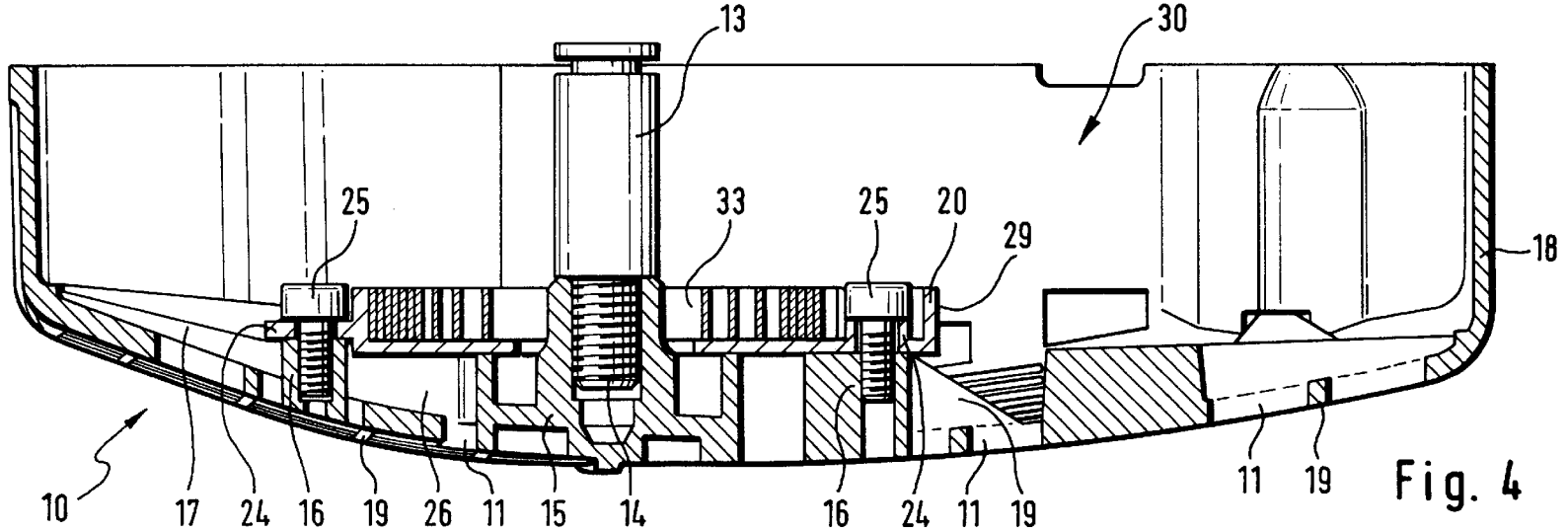
FIG. 4 is a section view taken along line IV—IV of FIG. 2.

The pull-rope starter 12 is mounted on a bearing lug 13 having a threaded end 14 held in an attachment base 15 of the blower cover 10. As shown in FIGS. 2 to 4, the attachment base 15 has, when the blower cover is viewed in plan, an approximately rectangular base form and defines a single closed surface of the blower cover 10. The air-intake openings 11 in the blower cover extend to the attachment base 15. The attachment base 15 borders on the air-intake openings 11 over its entire periphery.

The housing 20 of the pull-rope starter (that is, the housing of the return spring of the pull-rope starter) is configured as a component separate from the blower cover 10 and, in the assembled state, lies at a spacing (u) from the air-intake openings 11 of the blower cover 10. Screw pedestals 16 are provided on the blower cover 10 for attaching the housing 20 thereto.

As shown in FIGS. 3 and 4, side 21 of the spring housing 20 faces toward the air-intake openings 11. Also shown in FIGS. 3 and 4 is that this side 21 of the spring housing 20 lies on ribs (17, 27) which extend on the side of the blower cover facing toward the cooling air blower. Starting from the attachment base 15, each of the ribs 17 extends to the outer edge 18 of the blower cover 10 and is complimentary to the separation struts 19 between the air-intake openings 11. For this reason, the ribs (17, 27) are shown covered by the separation struts 19 in the plan view of FIG. 2 and are shown by broken lines. As shown in FIG. 2, three ribs 17 each extend in the longitudinal direction of the blower cover 10 to both sides of the attachment base 15 and are parallel to each other. The spacing of each two ribs 17 transversely to the longitudinal direction corresponds precisely to the elevation or width of two air-intake openings 11.

From the two sides of the attachment base 15, three ribs 27 each extend transversely to the longitudinal direction from the attachment base 15 and are in coincidence with the separation struts 19. The spacing of the ribs 27 to each other corresponds to the length of an air-intake opening 11. This length is measured in the longitudinal direction of the blower cover 10. The center rib is configured as to be significantly thicker.

The flat side 22 of the attachment base 15 faces toward the spring housing 20 of the pull-rope starter 12. This flat side 22 is configured as a support surface for the pull-rope starter housing 20. As shown in FIGS. 3 and 4, the flat side 22 of the attachment base 15 lies in one plane with the edges 23 of the ribs 17 and 27. The edges 23 face toward the spring housing 20. For this reason, the housing side 21 of the spring housing 20 lies, on the one hand, on the flat side 22 of the attachment base 15 and on the edges 23 of the ribs 17 and 27 whereby a plurality of support points are provided and distributed over the surface of the housing side 21. The spring housing 20 lies on the flat side 22 of the base 15 and the edges 23 and is attached to the blower cover 10 via attachment flanges 24 and attachment screws 25. The attachment screws 25 engage in the screw pedestals 16. In the embodiment shown, two screw pedestals 16 are provided and lie approximately diametrically opposite each other referred to the bearing lugs.

The height of the ribs 17 and 27 determines the spacing (u) of the spring housing 20 to the air-intake openings 11. As shown in FIG. 3, the spring housing 20, the attachment base 15 and two mutually adjacent ribs 17 mutually adjacent conjointly define an air-guide channel 26; and, the spring housing 20, the attachment base 15 and two mutually adjacent ribs 27 conjointly define air-guide channel 26. Each air channel extends to the outside from the attachment base 15 in the longitudinal direction or transversely to the longitudinal direction. Each air-guide channel 26 opens at the periphery 29 into the air-guide housing 30 which is covered by the hood-like blower cover 10. Each of the openings 28 extends over the entire cross section of the channel 26.

For a running engine, the cooling air is inducted by the cooling-air blower and flows through the plurality of air-intake openings 11 into the air-guidance housing 30 and is moved to the engine. The housing 20 of the pull-rope starter 12 (that is, the housing of the return spring of the starter 12) is at a spacing (u) to the air-intake openings 11 which are covered by the starter in the direction toward the cooling-air blower. For this reason, air can flow through the openings 11 and flows between the ribs (17, 27) approximately radially into the housing 20. Notwithstanding the attachment of the pull-rope starter or its spring housing 20 on the blower cover 10, no significant disadvantage as to the inflow area of the blower cover 10 results. The air-entry area, which is defined by the sum of the air-intake openings 11, is maximized.

The pull-rope starter shown in this embodiment of the invention essentially comprises a rope drum having a pull rope which is guided to the outside through an opening 31 in the blower cover 10. The pull rope is attached to a handle 32 as shown in FIG. 1. The pull-rope drum is operatively connected to a spiral spring 33 which is arranged in the shell-like spring housing 20. One of the ends of the housing 20 is attached fixedly to the housing via an attachment screw 25. The spiral spring 33 functions as a return spring to wind up the pull rope on the rope drum. The rope drum itself includes entraining claws (not shown) which engage in corresponding entraining latches on the lower wheel of the cooling-air blower. The bearing lug 13 therefore lies coaxially to the rotational axis of the cooling-air blower.

The blower cover 10 is a die-cast part made of a light material such as an aluminum alloy or magnesium alloy.

Preferably, the part is a magnesium die-cast part. The bearing lug 13, which is connected to the blower cover 10, preferably is made of steel or aluminum. The pull-rope starter housing 20 is advantageously made of steel, magnesium, aluminum or plastic.

It is understood that the foregoing description is that of the preferred embodiments of the invention and that various changes and modifications may be made thereto without departing from the spirit and scope of the invention as defined in the appended claims.

What is claimed is:

1. A portable handheld work apparatus including a motor-driven chain saw, brushcutter, cutoff machine or the like, the work apparatus including a work tool and comprising:

a housing having a side region;

an internal combustion engine mounted in said housing for driving said work tool;

a cooling-air blower mounted in said side region for supplying a flow of cooling air for cooling said engine; blower cover mounted in said side region upstream of said cooling-air blower;

said blower cover having a plurality of air-intake openings formed therein;

a pull-rope starter for starting said engine and said pull-rope starter having a return spring;

said blower cover having a bearing lug for accommodating said pull-rope starter thereon and said bearing lug being mounted on said blower cover so as to face toward said cooling-air blower;

a return-spring housing for holding said return spring therein;

said return-spring housing being configured as a component separate from said blower cover;

said blower cover having a wall surface facing toward said cooling-air blower;

said blower cover having an attachment base formed on said wall surface thereof;

said bearing lug having an end portion held in said attachment base;

said air-intake openings being arranged in said blower cover so as to extend to said attachment base;

said return-spring housing being attached to said blower cover and being disposed at a spacing (u) to at least a portion of said air-intake openings;

said blower cover having a plurality of ribs formed thereon; and, each two mutually adjacent ones of said ribs and said return-spring housing conjointly delimiting an air-conducting channel to facilitate an induction of air also through the air-intake openings adjacent said return-spring housing.

2. The portable handheld work apparatus of claim 1, said return-spring housing being in contact engagement with said ribs.

3. The portable handheld work apparatus of claim 2, said ribs determining said spacing (u) to said air-intake openings.

4. The portable handheld work apparatus of claim 3, said ribs extending outwardly over said wall surface and beyond said return-spring housing.

5. The portable handheld work apparatus of claim 1, said end portion being threadably engaged in said attachment base.

6. The portable handheld work apparatus of claim 1, said air-conducting channels extending outwardly from said attachment base.

7. The portable handheld work apparatus of claim 1, said attachment base having a flat surface defining a support surface for said return-spring housing.

8. The portable handheld work apparatus of claim 1, said blower cover being a cast member.

9. The portable handheld work apparatus of claim 8, said cast member being a plastic injection molded part or a magnesium pressure cast part.

10. The portable handheld work apparatus of claim 1, said return-spring housing being made of plastic, magnesium or aluminum.

* * * * *